United States Patent [19]

Peterson

[11] 4,244,299

[45] Jan. 13, 1981

[54] RAILWAY SIDE DOOR HOPPER CAR LOCKING MECHANISM

[75] Inventor: William H. Peterson, Homewood, Ill.

[73] Assignee: Pullman Incorporated, Chicago, Ill.

[21] Appl. No.: 905,067

[22] Filed: May 11, 1978

[51] Int. Cl.[3] ..... B61D 7/08; B61D 7/18; B61D 7/30; B65G 67/24

[52] U.S. Cl. ..... 105/251; 105/241.2; 105/308 R; 105/308 P; 105/309; 414/378; 414/388

[58] Field of Search ..... 105/241, 253, 261 A, 105/286, 287, 308 R, 308 E, 308 P, 309, 311 R, 241.1, 241.2, 251; 414/378, 387, 388

[56] References Cited

U.S. PATENT DOCUMENTS

| | | | |
|---|---|---|---|
| 1,225,522 | 5/1917 | Stickler | 105/261 A |
| 1,469,352 | 10/1923 | Anderson | 105/308 R |
| 1,569,997 | 1/1926 | Möller | 105/309 X |
| 1,615,671 | 1/1927 | Batho | 105/311 R X |
| 1,816,279 | 7/1931 | Curzon | 105/253 X |
| 2,400,026 | 5/1946 | Schroeder | 105/286 |
| 3,187,684 | 6/1965 | Ortner | 105/287 X |
| 3,315,616 | 4/1967 | Beaver et al. | 105/311 R X |
| 4,051,960 | 10/1977 | Raksanyi | 105/308 E X |
| 4,138,948 | 2/1979 | Korolis | 105/308 P X |

*Primary Examiner*—Howard Beltran
*Attorney, Agent, or Firm*—Richard J. Myers

[57] ABSTRACT

A locking arrangement for the side dump doors of a hopper car includes a pair of actuating levers projecting downward from the car engaging suitable trips mounted adjacent to the tracks which provides for longitudinal movement of a pair of latch bars which disengage a plurality of latches longitudinally disposed on the car between the hopper slope sheets and the swinging doors. Safety locks are provided to provide inadvertent opening of the latch mechanisms.

43 Claims, 12 Drawing Figures

RAILWAY SIDE DOOR HOPPER CAR LOCKING MECHANISM

BACKGROUND OF THE INVENTION

1. Field of the Invention

The invention relates to side dump railway hopper cars and more specifically to an improved locking and latching mechanism for latching swinging doors in a locked position and for disengaging the latches by means of a ground operated tripping mechanism.

2. Description of the Prior Art

The prior art contains a variety of mechanisms for operating the discharge gates of railway hopper cars. The present invention improves upon these various arrangements.

SUMMARY OF THE INVENTION

The railway car of the present invention includes an open top hopper having at its lower end, on opposite sides thereof, side discharge openings. The side discharge openings are closed by means of outwardly swinging discharge doors. Cars of this type discharge their materials by gravity upon unlocking of the doors. When the car has reached its destination and has been dumped the car doors are again closed by means of gravity by side of track camming devices for assisting in the closing of the doors. By virtue of the heavy loads encountered and the gravity discharge of the materials it is necessary to provide a strong lock arrangement which when the load is to be dumped is readily operable and which after dumping will securely again lock the doors in position by gravity or other means. Locks of this type therefore must be sufficiently strong to carry the loads which are encountered, must include safety features and must be easily actuated for release of the load to a dumping position. In the present invention a plurality of individual locks are provided at the lower portions of the hopper discharge openings and the associated doors, the locks being spaced at intervals of four to six feet apart along the length of each of the doors or gates which may extend the continuous length of the car on both sides. Each of the latches or locks of the present invention includes a hook shaped latch member which is pivotally mounted on the doors of the car. The latch member has a hook shaped end which in the closed position of the door projects through a slot or opening provided in a plate secured to the underneath side of the slope sheet of the hopper adjacent to a discharge opening. The hook shaped latch or lock in its locked position engages a vertical projecting ledge of an elongated bar which extends the length of each of the doors. During the locked position the projection on each bar engages the hook shape portions of the latch in a locked position. When the car reaches the dumping destination suitable trip cams are provided adjacent the railway track and these are engaged by vertically extending pivoted levers. The levers are mounted on the car for pivotal movement and are pivotally connected to the latch bars to move the same longitudinally whereupon the vertical locking projections of each of the bars is removed from underneath each hook shaped latch member and the latches are free to disengage. The doors are swung outwardly by gravity and the load is dumped. Each of the longitudinally extending latch bars is spring actuated so that immediately after disengagement by means of a trip lever the latch bar is again moved to its original position whereupon closing of the doors after dumping again provides for engagement of the latching elements with the projections of the latch bars to again lock the doors in the closed position. It should be particularly noted that the use of a single locking bar on each side of the car insures that all latches engage and disengage simultaneously preventing unequal loads and consequent structural damage to the gate.

The invention also provides for a pawl pivotally positioned on the hopper structure above each of the latch bars and this provides a safety lock which drops down and engages each hook shaped latch element to prevent it from being raised out of engagement with each longitudinally extending latch bar so that a safe secure lock is provided in each instance. The pawls are moved to an out of the way position when the hook shaped latching elements enter into locking relation relative to the longitudinal locking bar. Immediately however after engagement of the latch hook shaped locking element or latch the pawls are moved by gravity into the locking arrangement. A spring actuated pawl may also be provided for this purpose.

A modification of the invention includes longitudinally extending locking bars which are trip actuated and which have connected thereto the spring actuated pawl which is moved to one side of the hook shaped locking element for disengaging the same from locked condition and which when returned to the initial position again achieves locking of the hook shaped latch element after the load has been discharged from the hopper car.

DESCRIPTION OF THE PREFERRED EMBODIMENT

Figure 1:
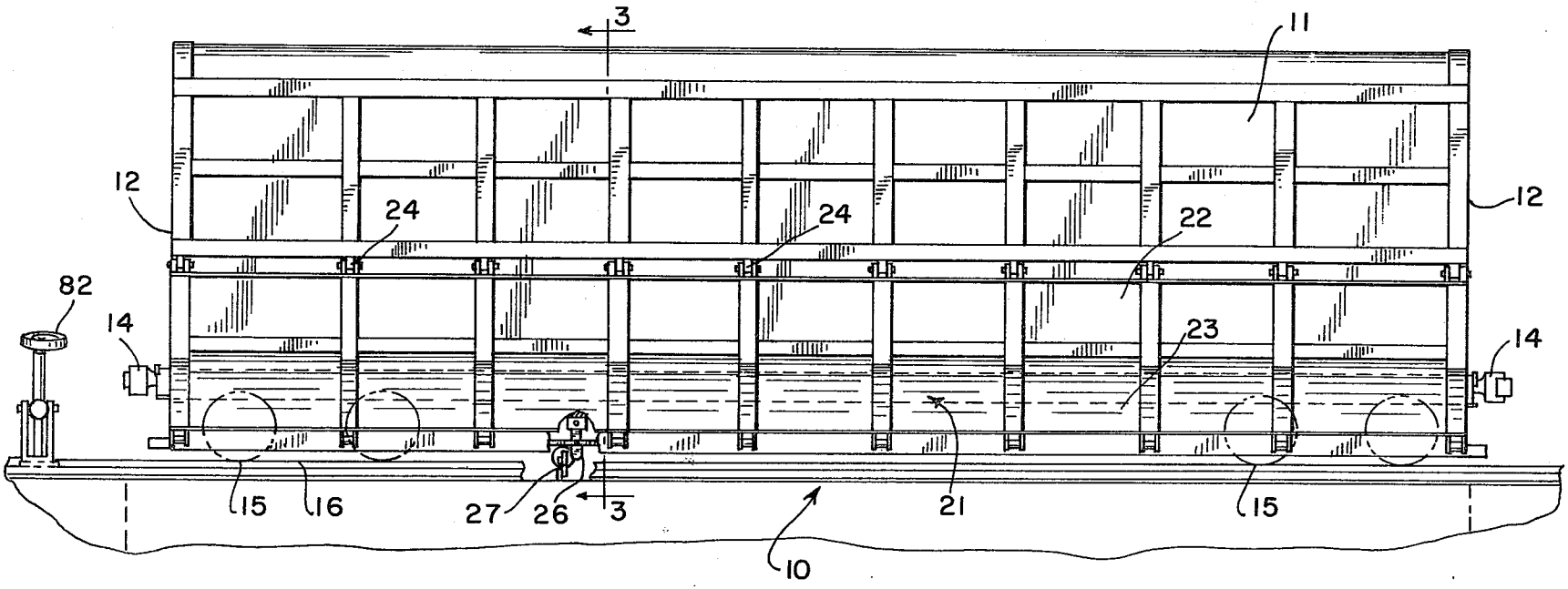
FIG. 1 is a side elevational view partially in section of a railway hopper car embodying the invention.
Figure 2:
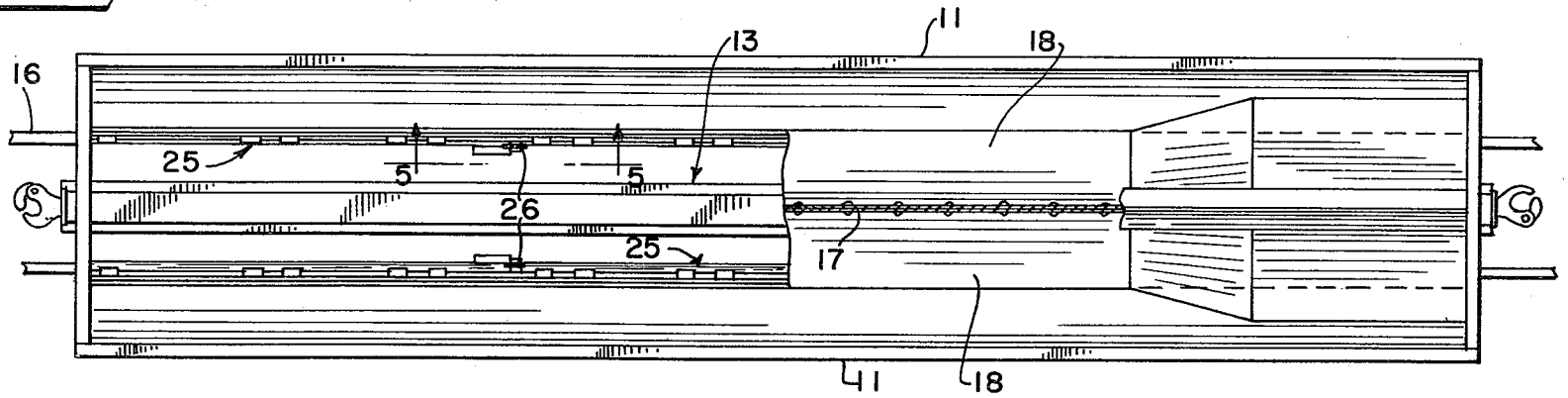
FIG. 2 is a plan view of the car disclosed in FIG. 1 having portions broken away to disclose a plurality of locking arrangements for the side discharge doors of the car.
Figure 3:
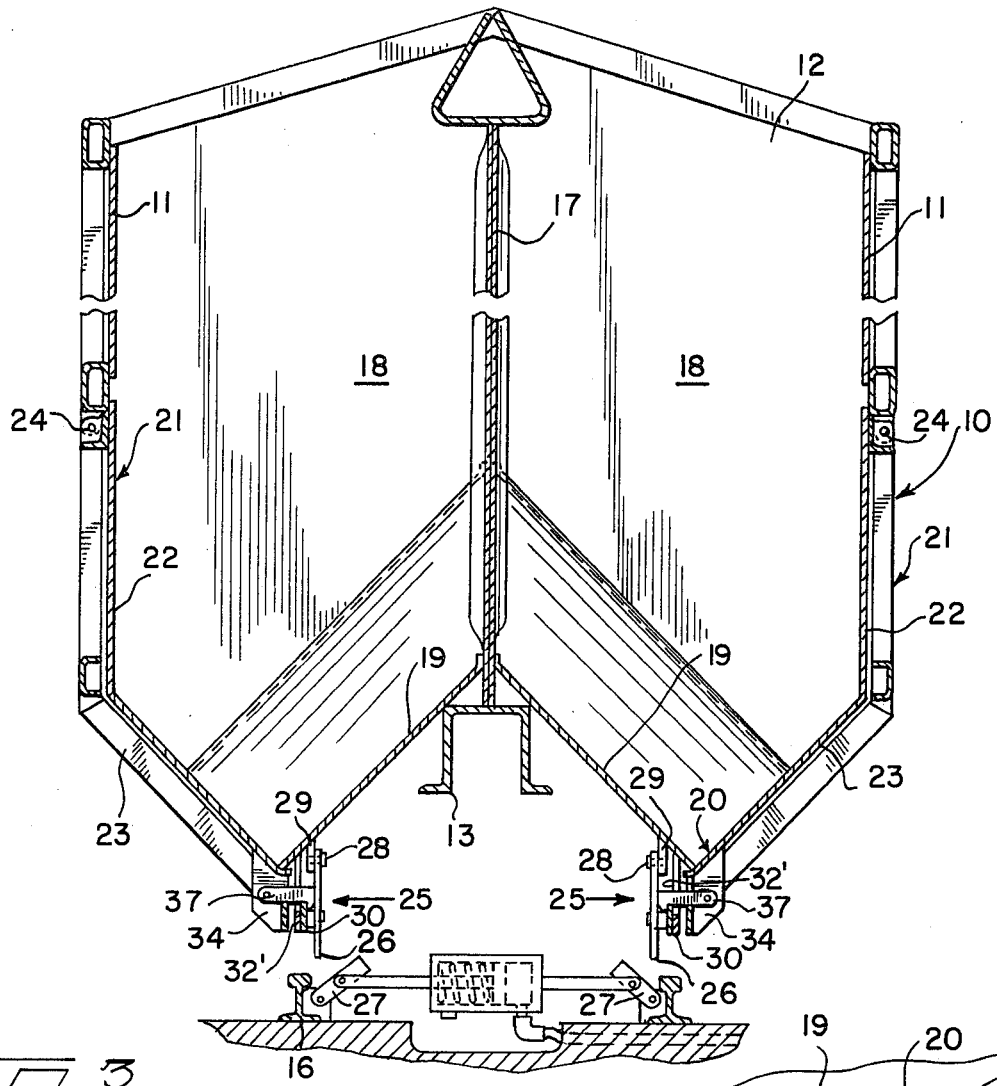
FIG. 3 is a cross-sectional view taken substantially along the lines 3—3 of FIG. 1.
Figure 4:
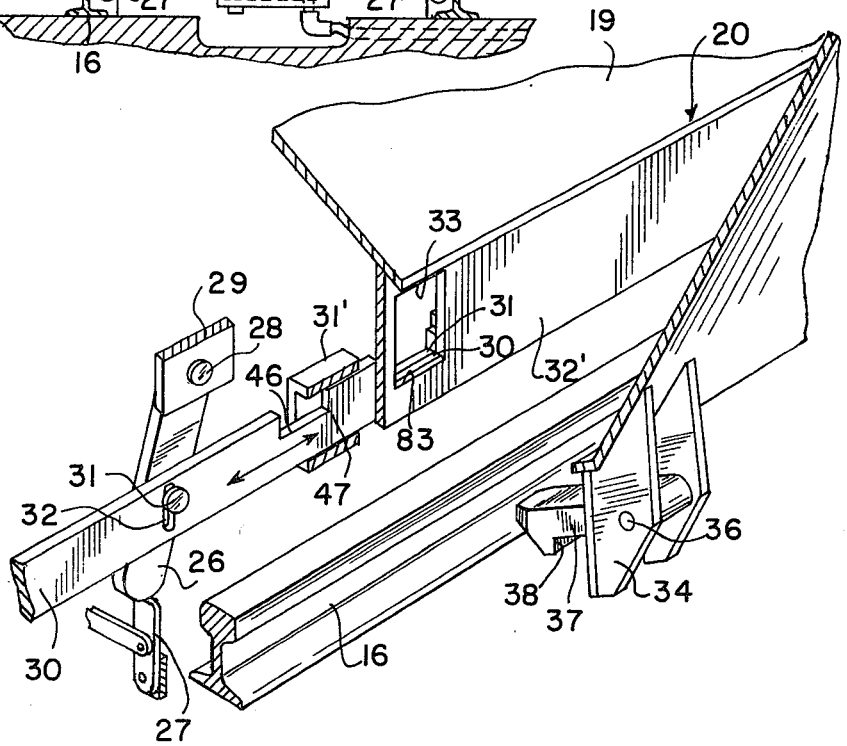
FIG. 4 is a perspective view of a portion of the car showing a trip mechanism and locking arrangement for the side doors of a railway hopper car.

FIGS. 1, 2 and 3 disclose a railway hopper car 10 having conventional car sides 11 and car ends 12. The car 10 is supported on a center sill and underframe structure generally designated at 13 which is provided at opposite ends with conventional couplers 14. Conventional wheel trucks 15 support the underframe structure 13 on a suitable railway track designated at 16. The railway car 10 includes a central divider 17 extending substantially the length of the car to provide a pair of elongated side by side hopper structures generally designated at 18. Each of the hopper structures 18 is provided with suitable slope sheets 19 adapted to direct materials from within the hopper laterally outwardly through discharge openings 20 to the side of the railway track. Each of the discharge openings 20 is adapted to be closed by means of elongated door structures 21 which extend on opposite sides the entire length of the car. Each door structure comprises an upright panel 22 and a lower diagonal panel 23 for closing the discharge opening 20. The upright panel 22 includes hinge brackets 24 suitably connected to the sides of the hopper car along longitudinally spaced intervals.

The present invention relates to door locking and latching arrangements which are generally designated at 25, and as shown in FIG. 2, extend along the underneath length of the car adjacent to the discharge openings at intervals of approximately 4 to 6 feet for securely locking the door structures in a closed position. The door locking arrangements include a pair of tripping levers 26, one for each of the doors on opposite sides of the car. A pair of off-car or ground mounted cams 27 are positioned adjacent to the tracks and are adapted to engage the tripping levers 26 when the car is at a position where the load is to be discharged.

Figure 5:
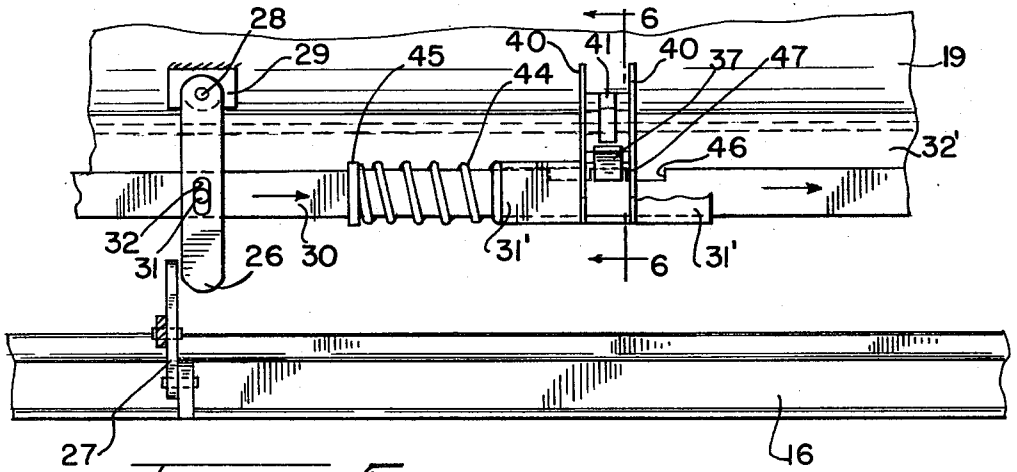
FIG. 5 is a cross-sectional view taken substantially along the lines 5—5 of FIG. 2.
Figure 7:
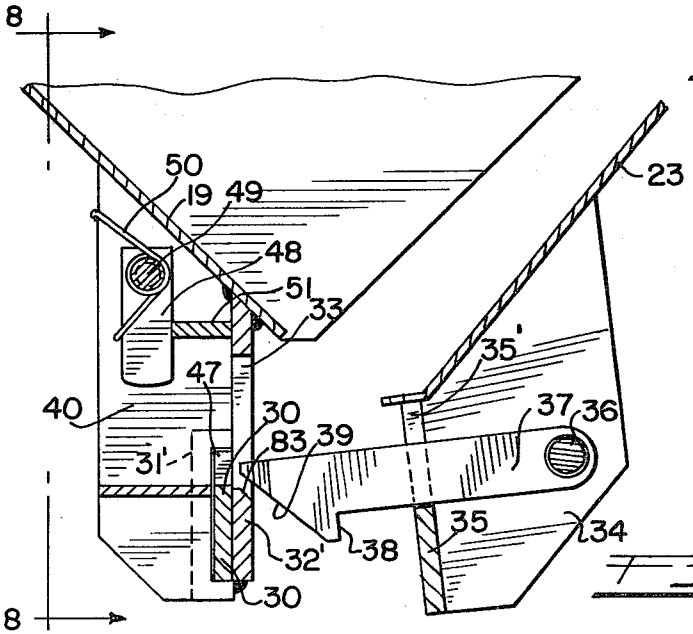
FIG. 7 is a view similar to FIG. 5 showing a spring actuated pawl arrangement.
Figure 6:
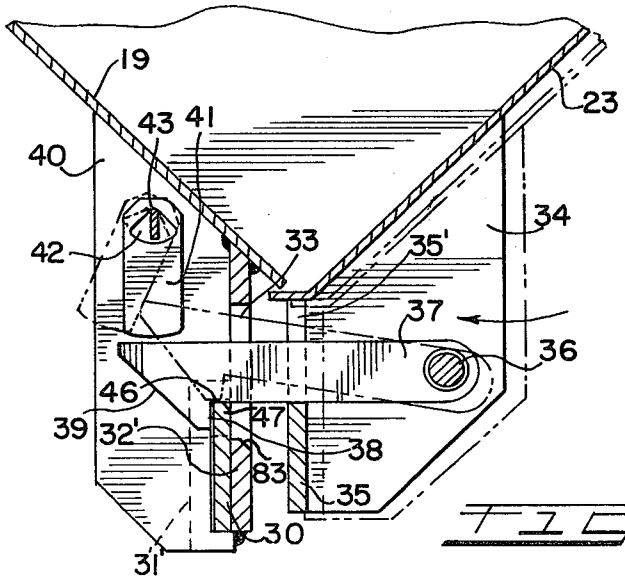
FIG. 6 is a cross-sectional view taken substantially along the lines 6—6 of FIG. 5.

Each of the tripping levers 26 is pivotally connected to the railway car by means of pivots 28 extending through brackets 29 suitably supported by the underneath surface of the hopper slope sheets as best shown in FIG. 3. The tripping levers 26 are pivotally connected to a keeper arrangement which includes longitudinal locking or keeper bars 30. The bars 30 are connected to levers 26 by means of pivot pins 31 extending through vertical slots 32 provided in each of the bars 30. The bars 30 extend substantially the length of the car doors so as to trip each of the longitudinally spaced latching mechanisms which are provided and which will be described. Adjacent each of the locking mechanisms there is provided a tubular guide 31' which is rigidly secured to a vertical plate 32' projecting downwardly on opposite sides of the center line of the car. The plate 32' may be suitably connected to the downwardly extending slope sheets 19. Each of the plates 32' is provided with a rectangular opening 33 for receiving a hook shaped latch or locking element 37. A latch support 34 is provided along the lower ends of the doors at spaced intervals to coincide with the openings 33 of the plate 32. The latch support 34 also is provided with a forward wall or plate 35 which includes a slot 35'. The hook shaped latch or locking element 37 is connected by means of a pivot 36 for swinging movement to the latch support 34. The end of the locking element 37 includes a hook shaped portion generally designated at 38 which also includes a tapered or cam surface 39. A pair of upright plates 40 as best shown in FIGS. 5, 6 and 7 are connected to the underneath side of the slope sheet 19 and project downwardly with respect thereto. The plates 40 are suitably apertured to register with the openings provided with the guides 31' to provide reciprocating movement therethrough of the longitudinal actuating bar 30. The plates 40 support thereon a gravity actuated pawl or safety lock 41 which is best shown in FIG. 5. The upper end of the pawl 41 is provided with a triangular hole 42 which at its apex hangs upon a relatively thin plate bracket 43 so that it hangs by gravity vertical in the position indicated in FIG. 6.

Referring now particularly to FIG. 5 a spring 44 is held captive at one end by the tubular guide 31' and is wrapped around the bar 30 and held captive at its other end by means of a spring retainer 45. The actuating bar 30 as best shown in FIGS. 5–8 is provided with a spaced cutout 46 which provides for an upstanding lock projection or tab 47 which in the locking position of the bar 30 engages the hook 38 to lock the latch or locking element 37 in the position shown in FIG. 6. Upon engagement of the lever 26 with the trip element 27 the bar 30 is moved to the right as shown by the arrows in FIG. 5 which thus further compresses the prebiased or compressed spring and moves the lock projections 47 to the right or laterally of the hook shaped element 37 whereupon the door is now capable of opening by gravity since the hook is no longer engaged. During the locked position as shown in FIG. 6, of the hook shaped element 37, the gravity pawl 41 is adapted to prevent any upward movement of the latch element 37 and thus retains the same in a locked position when desired.

Figure 8:
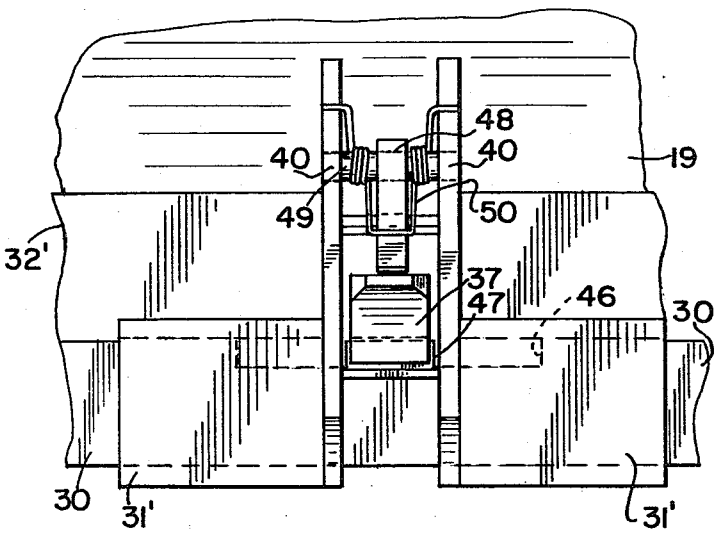
FIG. 8 is a side elevational view partially in section taken substantially along the lines 8—8 of FIG. 7.

In the modification shown in FIGS. 7 and 8 the structure is substantially similar with the exception that the pawl 48 is spring actuated to maintain the vertical position shown against the stop 51. The description of the operation of the spring pawl will be further described below.

DESCRIPTION OF A MODIFIED EMBODIMENT

Figure 12:
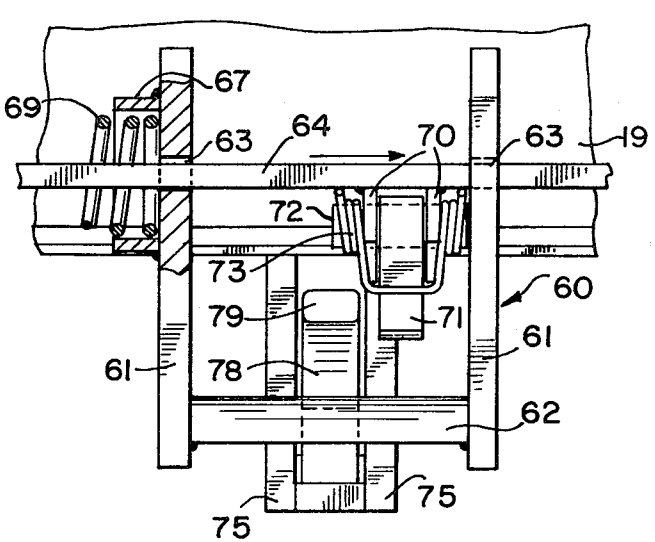
FIG. 12 is a cross-sectional view taken substantially along the lines 12—12 of FIG. 11.
Figure 9:
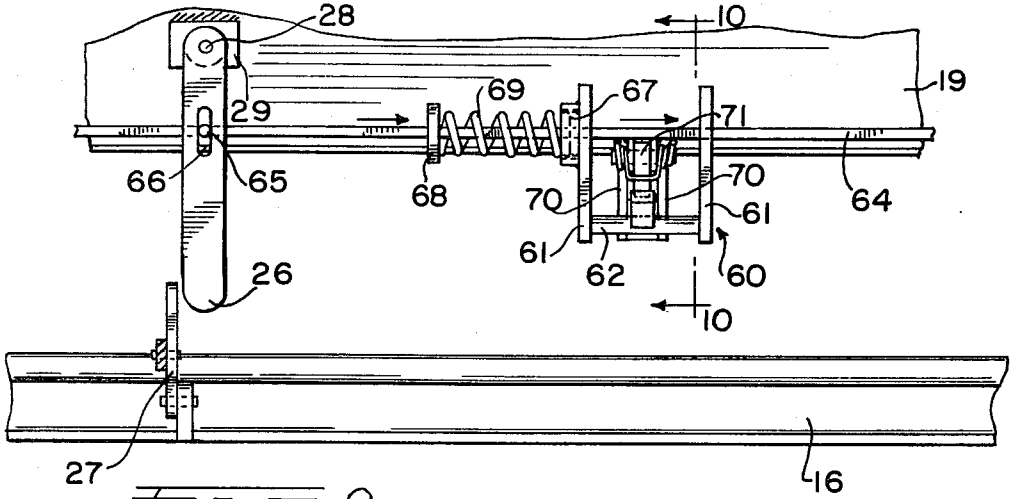
FIG. 9 is a view similar to FIG. 5 showing a modified form of actuating or latch bar arrangement.

FIGS. 9 through 12 disclose a modified form of the invention and where applicable the same reference characters apply. In the present arrangement a keeper arrangement is designated at 60. The keeper arrangement 60 comprises a pair of spaced plates 61 which are suitably connected to the underneath side of the hopper slope sheets 19. The spaced plates 61 have rigidly connected thereto a keeper bar 62. Aligned slots 63 in the plate 61 accommodate the sliding movement of a flat bar 64 which is similar to the bar 30 of the preferred embodiment and which is connected to a similar trip lever 26 by means of a pivot pin 65 positioned within a slot 66 in the lever 26. A spring retainer 67 as shown in FIG. 9 is provided on one of the plates 61 and engages one end of a spring 69 which is retained captive on the bar 64 by means of a spring retainer 68. A pair of ears 70 as best shown in FIG. 12 are rigidly connected to the bar 64 to slide therewith. The ears 70 support a pawl 71 for rotation on a shaft 72. A spring arrangement 73 normally urges the pawl 71 to the position shown in FIG. 10 against a stop 74.

In the present modification a pair of latch brackets 75 are provided on the underneath side of the door 23 to pivotally support by means of a pivot shaft 83, a hook shaped latch element 76. The hook shaped latch element 76 includes on its lower surface an arcuate depression or seat 77 which is adapted to engage in complemental relation the curved surface of the keeper bar 62. The hook shaped latch 76 is also provided with a tapering cam surface 78 and a cammed end 79. The lower end of the pawl 71 is provided with a curved portion 80 which is adapted to seat upon and engage a curved portion 81 provided on the upper surface of the hook shaped latch 76.

THE OPERATION

Referring now particularly to FIG. 5 the unlocking of the doors will be described. As the trip lever 26 engages the trip 27 the bar 30 is moved in the direction of the arrows to the right whereupon the raised lock projection 47 is displaced to the right and therefore is disengaged from the hook 38 of the locking or latch member 37. Thus as shown in FIG. 7 the latch member can now slide through the opening 33 and the load is dumped by gravity. All of the latch mechanisms disposed along the length of the car thereby are opened simultaneously by movement of the longitudinal bar in response to the tripping action of the lever 26, thus essentially obviating the possibility of structural damage to the gate resulting from unequal loading. By virtue of the springs 44 the latch bar is immediately returned to the position shown in FIG. 5 where it is now again ready to lock the latch mechanisms in position after the load is dumped. As the doors 23 now close the latch element 37 has its tapering surface 39 engage the edge 83 provided in the plate 32' within the opening 33 whereupon the tapering edge provides for upward movement of the latch member 37 and through the opening 33. The tapering surface 39 also moves upwardly on top of the lock projection 47 and continues its upward movement as shown in FIG. 6 whereupon the tip portion engages the pawl 41 as shown in the dotted lines in FIG. 6 to move the pawl 41 to an out of the way position. Upon this occurrence the latch elements 37 now move to the horizontal position as shown in FIG. 6 with the hook 38 also in locking engagement with the projection 47. The pawl 41 now drops by gravity to the position in the solid lines indicated in FIG. 6 and vertical unlocking movement of the latch 37 is thus prevented. Thus a safe locking arrangement is provided which cannot accidentally open. Also an effective lock results which upon closing of the doors immediately firmly locks the doors in position.

In the modification of FIG. 7 the operation is identical insofar as the locking procedure is concerned, the only difference being that the pawl 48 is actuated by the spring 50 to the vertical position and the action of the locking element against the pawl 48 to place it to its out of the way position is against the action of the spring. Otherwise the operation is the same as described in FIG. 6.

OPERATION OF THE MODIFICATION SHOWN IN FIGS. 9–12

Figure 10:
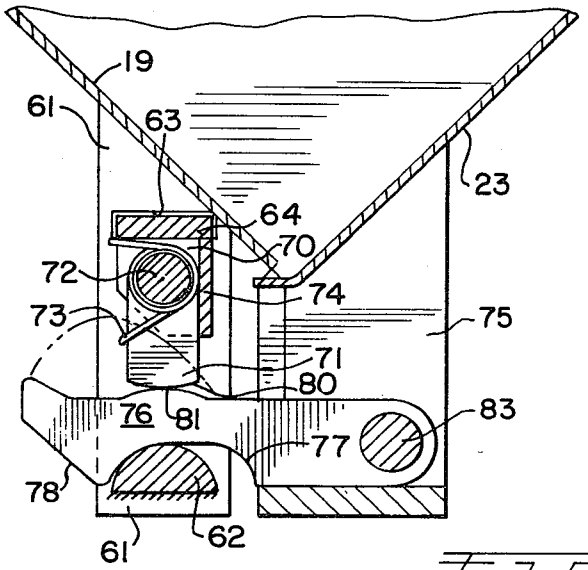
FIG. 10 is a cross-sectional view taken substantially along the lines 10—10 of FIG. 9.

Referring now to FIG. 9 as the trip lever 26 engages the trip element 27 the locking bar 64 is moved in the direction of the arrows to the right compressing the spring 69 against one of the plates 61. Movement of the bar 64 provides for movement of the pawl 71 laterally as indicated in FIG. 12, that is to one side of the locking element 76. In its locked position the locking element as shown in FIG. 10 has its curved upper surface in complemental engagement with the arcuate slotted portion 77 of the locking element. The curved edge 80 of the pawl engages the upper curved edge 81 of the locking element and the locking pawl is firmly fixed in this position by means of the spring 73 against the stop 74. Thus in this position secure locking takes place. However as the pawl is moved laterally out of the locking position with respect to the locking elements 76 as shown in the position of FIG. 12 the door is now free to open by virtue of the disengaged position of the pawl from that which is shown in FIG. 10. Thus the doors open easily and the load is dumped.

Figure 11:
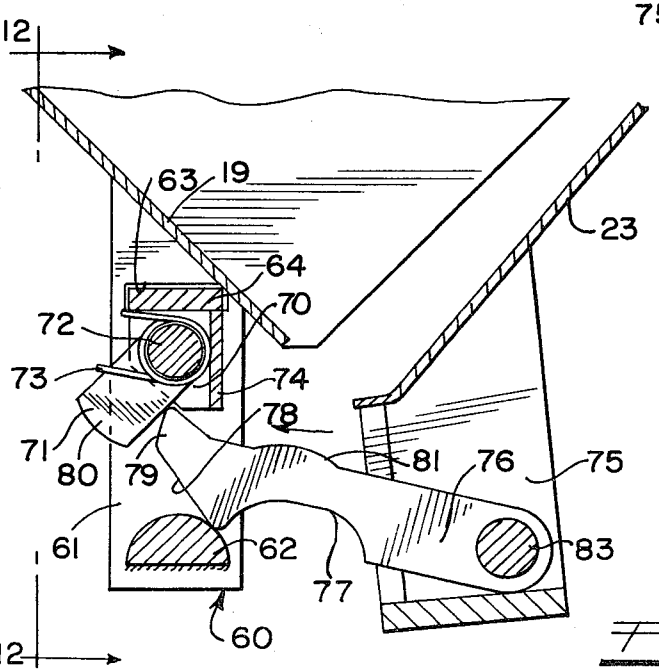
FIG. 11 is a view similar to FIG. 10 showing an unlocking condition of the locking mechanism.

As best shown in FIG. 11 after the load has been dumped and the doors are again closed by gravity the hook shaped locking element 76 first engages and rides upwardly on top of the curved surface of the keeper bar 62 which in turn provides for engagement of the cammed end 79 with the pawl 71 moving the same to the position shown in FIG. 11. Continued closing movement causes re-engagement of the keeper bar 62 into the arcuate depression or seat 77 and again the pawl 71 returns to the position shown in FIG. 10 providing a firm and safe lock to prevent any disengagement of the locking element 76.

Thus it is believed that an effective pair of locking arrangements have been described which will provide for positive locking of the side discharge doors of a hopper car and which are easily disengaged and repositioned for subsequent locking action.

What is claimed is:

1. For a railway hopper car having a hopper including a downwardly and outwardly extending slope sheet structure terminating adjacent to a side discharge opening, and, a door hingedly connected to said car for swinging movement between open and closed positions relative to said opening, the improvement of a locking arrangement comprising, a latch member hingedly connected to said door including a hook shaped locking element adjacent one end thereof, a keeper arrangement supported on said hopper, said keeper arrangement including a reciprocating keeper element adapted to be selectively moved between lock and unlock positions relative to said hook shaped locking element, said hook shaped locking element being adapted for relative movement transversely of said keeper element, locking means movably supported on said hopper engaging said hook shaped locking element in the closed door position to lock the hook shaped element in the lock position of said keeper element, said hook shaped element engaging said locking means during closing movement of said door to move the locking means to an out-of-the-way position whereupon said hook shaped element assumes its locked position relative to said keeper element and said locking means assumes its engaged position relative to said hook shaped element, and means for moving said keeper element for unlocking said hook shaped element from said locking element.

2. The invention in accordance with claim 1, said means for moving said keeper element including lever means, and associated off car tripping means adapted to be engaged by said lever means during movement of said car.

3. The invention in accordance with claim 1, said locking means including a pawl pivotally supported above said hook shaped locking element.

4. The invention in accordance with claim 3, said hook shaped element having a lower tapering cam surface engaging said keeper element during closing of said door thereby guiding said hook shaped element in its engaging movement relative to said pawl.

5. The invention in accordance with claim 3, including a spring connected to said reciprocating keeper element urging the same to said lock position.

6. The invention in accordance with claim 3, said pawl being pivotally supported at its upper end and maintaining its engaging position by force of gravity.

7. The invention in accordance with claim 3, said pawl being urged into said engageable position relative to said locking element by spring means.

8. The invention in accordance with claim 3, said keeper arrangement including a vertical plate connected to said hopper and having an opening for receiving said hook shaped locking element, and said reciprocating keeper element including a vertical projecting portion movable into registry with said opening and engaging said locking element in said lock position.

9. The invention in accordance with claim 8, said keeper arrangement including guide means connected to said plate for supporting said reciprocating keeper element.

10. The invention in accordance with claim 9, said guide means having an opening registering with said opening in said plate.

11. For a railway hopper car having a hopper including a downwardly and outwardly extending slope sheet structure terminating adjacent to a side discharge opening, and a door hingedly connected to said car for swinging movement between open and closed positions relative to said opening, the improvement of a locking arrangement comprising;

a latch member hingedly connected to said door, said latch member including a hook shaped locking element adjacent one end thereof, a keeper arrangement supported on said hopper, said keeper arrangement including a reciprocating keeper element adapted to be selectively moved between lock and unlock positions relative to said hook shaped locking element, said hook shaped locking element being adapted for relative movement transversely of said keeper element, a locking pawl movably supported on said hopper above said hook shaped locking element and adapted to engage the same to lock the same in said lock position of said keeper arrangement, means biasing said reciprocating keeper element to its lock position, said hook shaped element during closing movement of said door engaging said pawl to move the same to an out-of-the-way position relative to said hook shaped element and whereupon said hook shaped locking element assumes its locked position relative to said keeper element, and said pawl again assumes its engaged position relative to said keeper element, and means for moving said keeper element for unlocking the same from said locking element.

12. The invention in accordance with claim 11 said pawl during movement of said bar being displaced laterally with respect to said hook shaped portion.

13. The invention in accordance with claim 12, said pawl being positioned between said support plates.

14. For a railway hopper car having a hopper including a slope sheet structure terminating adjacent to a side discharge opening, and a door hingedly connected to said car for swinging movement between open and closed positions relative to said opening, the improvement of a locking arrangement comprising;

a latch element having a hook shaped portion, means hingedly connecting said latch element to said door, a keeper arrangement supported on said car including a fixed keeper member, said hook shaped portion being adapted for relative movement transversely of said keeper arrangement, said fixed keeper member being engaged by said hook shaped portion in locking relation during a locked position of said door, a reciprocating bar mounted on said car adjacent to said keeper member, a locking pawl supported on said reciprocating bar, said pawl in said locked position engaging said hook shaped portion to maintain the same in locked relation relative to said keeper member, and means for reciprocating said bar for moving said pawl to one side of said hook shaped portion whereby the same is disengaged from said locking relative to said hook shaped portion.

15. The invention in accordance with claim 14, said locking pawl being pivotally supported above said hook shaped portion and in the locked position engaging said hook shaped portion in locking relative to said keeper.

16. The invention in accordance with claim 15, said hook shaped portion including a lower surface having a notch engaging said keeper member, said portion further including a tapering cam surface engaging said keeper member during closing of said door in sliding relative, whereby said portion is moved upwardly into engagement with said pawl to move the same to an out-of-the-way position and said keeper is engaged in said notch and said pawl returns to said locked position.

17. The invention in accordance with claim 14, said means for reciprocating said bar including lever means, off-car tripping means adapted to be engaged by said lever means during movement of said car, and biasing means connected to said bar.

18. The invention in accordance with claim 17, said locking pawl including biasing means urging the same into said locked position.

19. The invention in accordance with claim 18, said pawl engaging the upper surface of said hook shaped position in the locked position.

20. The invention in accordance with claim 19, said fixed keeper member including a pair of spaced support plates, having a keeper element supported therebetween, said plates including aligned openings within which said bar is adapted to reciprocate.

21. A railway hopper car including a hopper having a downwardly extending discharge opening, a door hingedly connected to said car for movement between open and closed positions relative to said opening, and a locking arrangement for securing said door in the closed position comprising:

a latch member pivotally connected to said door, a keeper arrangement supported on said hopper including a reciprocating keeper element selectively movable between locking and unlocking, said latch member being adapted for relative movement transversely of said keeper element, said latch member engaging said keeper element in the locking position in the closed door position, and locking means movably supported on said hopper for engaging said latch member in the closed door position to maintain the latch element in locking engagement with said keeper element in the locking position of said keeper element.

22. The invention in accordance with claim 21, and said latch member engaging said locking means during closing movement of said door to move the locking means to an out-of-the-way position whereupon said latch member engages said keeper element and said locking means engages said latch members.

23. The invention in accordance with claim 21, and said locking means is pivotally mounted on said hopper for movement about a generally horizontal axis.

24. The invention in accordance with claim 21, wherein said locking means comprises a pivotally mounted pawl mounted on said hopper.

25. The invention in accordance with claim 24, and said locking means further comprising biasing means for urging said pawl into engagement with said latch member in the closed door position.

26. The invention in accordance with claim 21, wherein said latch member pivots about a generally horizontal axis and has limited pivotal movement.

27. The invention in accordance with claim 26, wherein said latch member includes a hook shaped locking element engageable with said keeper element.

28. The invention in accordance with claim 21, wherein said keeper element includes an upstanding tab which in the locking position engages said latch member in the closed door position.

29. The invention in accordance with claim 28, wherein, said upstanding tab is disengaged from said latch member as said keeper element moves from the locking to the unlocking position.

30. The invention in accordance with claim 21 or 29, wherein, said keeper arrangement includes biasing means for urging said keeper element to the locking position.

31. A railway hopper car including a hopper having a downwardly extending discharge opening, a door hingedly connected to said car for movement between open and closed positions relative to said opening, and a locking arrangement for securing said door in the closed position comprising:

a latch member pivotally connected to said door, a keeper arrangement supported on said hopper including a reciprocating keeper element selectively movable between lock and unlock positions, a locking element movably mounted on said keeper element and reciprocable therewith, and a keeper bar affixed to said hopper, and said latch member being adapted for relative movement transversely of said keeper arrangement and said latch member engaging said keeper bar and said locking element in the closed door position in the lock position of said keeper element, said latch member being entrapped by said keeper bar and locking element to maintain said door in the closed position.

32. The invention in accordance with claim 31, wherein said locking means comprises a pawl engageable with said latch member pivotally mounted on said keeper element, said pawl being in registry with said latch member in the lock position of said keeper element.

33. The invention in accordance with claim 32, wherein said locking means further comprises biasing means for urging said pawl into engagement with said latch member, said latch member engaging said pawl during movement of said door toward its closed position thereby moving said pawl to an out-of-the-way position whereupon continued movement of the door toward the closed position engages said latch member with said keeper bar, whereupon said pawl entrappingly engages said latch member.

34. The invention in accordance with claim 31, wherein said keeper arrangement includes biasing means for urging said keeper element to the lock position.

35. The invention in accordance with claim 34, and lever means pivotally mounted on said car and operatively connected to said keeper element, for reciprocating same, said lever means being engageable by associated off-car tripping means for moving said keeper element from the lock to the unlocked position.

36. In a railway hopper car having a hopper including a downwardly and outwardly extending slope sheet structure terminating adjacent to a side discharge opening, a door operating mechanism comprising:

a door hingedly connected to said car for swinging movement between open and closed positions relative to said opening, a latch member pivotally connected to said door including a hook shaped locking element adjacent one end thereof, a keeper arrangement supported on said hopper and keeper with said latch member, said latch member being adapted for relative movement transversely of said keeper arrangement, said keeper arrangement including a reciprocating keeper element adapted to be selectively moved between locking and unlocking positions relative to said hook shaped lock element, locking means movably supported on said hopper and engaging said hook shaped element to lock the same in the lock position of said keeper element, and means for moving said keeper element for unlocking said hook shaped element from said locking element.

37. The invention in accordance with claim 36, wherein said locking means are in registry with said latch menber in the locking position of said keeper element.

38. The invention in accordance with claim 36, wherein said latch member limitedly pivotal about a generally horizontal axis.

39. The invention in accordance with claim 38, wherein said locking means includes a pawl pivotal about a generally horizontal axis generally parallel to the axis of said latch members.

40. The invention in accordance with claim 36, wherein said locking means are carried by and reciprocable with said keeper element, and said keeper arrangement further includes a keeper bar affixed to said hopper whereby said latch member engages and is entrapped between said locking means and said keeper bar in the locking position of said keeper element when said door is in the closed position.

41. The invention in accordance with claim 40, wherein said locking means comprises a pawl pivotally mounted on said keeper element, and pawl being in registry with said latch member in the locking position of said keeper element.

42. The invention in accordance with claim 36, wherein said latch member engages said keeper element in the locking position of said keeper element when said door is in the closed position and said locking means engages said latch member to maintain said latch member in locking engagement with said keeper element.

43. The invention in accordance with claim 42, wherein said keeper element includes an upstanding projection lockingly engaged by said latch member in the closed door position.

* * * * *